US005860269A

United States Patent [19]

Takahashi et al.

[11] Patent Number: 5,860,269

[45] Date of Patent: Jan. 19, 1999

[54] DEVICE FOR FEEDING STOCK SHEETS

[75] Inventors: Tadashi Takahashi; Tomoyuki Ochi; Yuji Hanazawa, all of Tokyo, Japan

[73] Assignee: Tokyo Automatic Machinery Works, Ltd., Tokyo, Japan

[21] Appl. No.: 881,149

[22] Filed: Jun. 24, 1997

[30] Foreign Application Priority Data

Jun. 28, 1996 [JP] Japan ..... 8-169640

[51] Int. Cl.[6] ..... B65B 43/18

[52] U.S. Cl. ..... 53/64; 53/207; 414/795.5; 414/797.4; 493/14; 493/313

[58] Field of Search ..... 53/64, 462, 207, 53/456, 564; 493/14, 13, 10, 18, 17, 315, 316, 317, 313, 314; 414/797.7, 797.4, 797.8, 795.4, 795.5

[56] References Cited

U.S. PATENT DOCUMENTS

| | | | |
|---|---|---|---|
| 2,732,203 | 1/1956 | Stancheff | 53/64 X |
| 3,530,640 | 9/1970 | Hoffmann | 53/64 X |
| 3,814,000 | 6/1974 | Heisler | 493/316 |
| 5,116,303 | 5/1992 | Dietrich et al. | 493/316 |
| 5,372,569 | 12/1994 | Ballos, III | 493/316 |
| 5,653,671 | 8/1997 | Reuteler | 493/315 X |

FOREIGN PATENT DOCUMENTS

| | | |
|---|---|---|
| A-2127226 | 5/1990 | Japan . |
| 6-30644 | 8/1994 | Japan . |

*Primary Examiner*—James F. Coan

[57] ABSTRACT

A device for feeding stock sheets is provided with a hopper for storing carton blanks as stock sheets in an upright posture, a delivery roller for delivering the carton blanks in the hopper toward a hopper outlet, an auxiliary roller located between the delivery roller and the hopper outlet to deliver the carton blanks toward the hopper outlet, a plurality of gap sensors used to detect gaps between the carton blanks situated between the delivery roller and the auxiliary roller and to control the delivery roller in rotation, and an arrival sensor used to detect a gap between the hopper outlet and the leading stock sheet and to control the auxiliary roller in rotation.

15 Claims, 11 Drawing Sheets

DEVICE FOR FEEDING STOCK SHEETS

BACKGROUND OF THE INVENTION

1. Field of the Invention

The present invention relates to a device for feeding stock sheets one after another, and more particularly, to a device adapted to feed carton blanks as stock sheets to a packaging machine.

2. Description of the Related Art

Feeding devices of this type are described in Jpn. UM Appln. KOKOKU Publication No. 6-30644 and Jpn. Pat. Appln. KOKAI Publication No. 2-127226, individually, for example. These conventional feeding devices comprise a hopper for stock sheets. A large number of stock sheets are stored upright in the hopper. Suction pads are arranged for movement in the vicinity of an outlet of the hopper. The suction pads attract by suction a leading stock sheet having reached the hopper outlet, and draw it out from the hopper through the outlet.

The feeding devices further comprise a rotatable delivery roller, which is located at a predetermined distance from the hopper outlet, and the outer peripheral surface of which slightly projects from the bottom wall of the hopper. As the delivery roller rotates, it can deliver the stock sheets in the hopper to the hopper outlet. The rotation of the delivery roller and its suspension are controlled in accordance with the number of stock sheets stored in an outlet region between the roller and the hopper outlet.

More specifically, a sensor is located over the delivery roller, and the sensor is used to detect the degree of storage of the stock sheets in the starting end of the outlet region directly on the downstream side of the delivery roller. As the stock sheets are drawn out repeatedly through the hopper outlet, those sheets which are in the outlet region of the hopper are guided in succession to the hopper outlet. Accordingly, the number or storage degree of the stock sheets remaining in the starting end of the outlet region decreases gradually. The sensor detects the degree of storage of the stock sheets, and outputs a detection signal when the piling degree is reduced to a predetermined or lower value. In response to this detection signal output, the delivery roller is rotated to deliver new stock sheets into the output region of the hopper.

Since the stock sheets are delivered intermittently into the output region of the hopper, as described above, the degree of storage of the stock sheets in the outlet region varies, which makes the operation of the suction pads for drawing out the sheets unstable. If the degree of storage of the stock sheets in the outlet region is too low, the suction pads cannot adhere satisfactorily to the leading stock sheet, possibly failing to attract it by suction. If this storage degree is too high, on the other hand, the force of adhesion between the adjacent stock sheets is great. When the suction pads attract and draw out the leading stock sheet, therefore, a succeeding stock sheet may stick to the leading one in some cases. The frequency of this awkward phenomenon increases in proportion to the speed at which the stock sheets are drawn out from the hopper.

SUMMARY OF THE INVENTION

The object of the present invention is to provide a stock sheet feeding device capable of securely and steadily drawing out stock sheets one after another from a hopper at a higher speed.

The above object is achieved by a stock sheet feeding device according to the present invention, which comprises:

hopper means for storing stock sheets in an upright posture, the hopper means including a hopper having a hopper outlet and a receiving member provided at the hopper outlet to receive an upper portion of the leading stock sheet at the hopper outlet, thereby positioning the leading sheet; draw-out means for drawing out the leading stock sheet from the hopper outlet, the draw-out means including a suction pad for attracting the leading stock sheet in a position under the receiving member; first delivery means for delivering the stock sheets in the hopper toward the hopper outlet at a first delivery position defined in the hopper; second delivery means for delivering the stock sheets in the hopper toward the hopper outlet at a second delivery position defined between the first delivery position and the hopper outlet; first detecting means for detecting a degree of storage of the stock sheets between the first and second delivery positions; second detecting means for detecting a degree of storage of the stock sheets between the second delivery position and the hopper outlet; and controlling means for controlling operations of the first and second delivery means independently in accordance with the degrees of storage of the stock sheets detected by the first and second detecting means.

According to the stock sheet feeding device arranged in this manner, if the degree of storage of the stock sheets detected by the second detecting means becomes lower than a predetermined value as the stock sheets are drawn out from the hopper, the control means actuates the second delivery means, thereby delivering the sheets toward the hopper outlet. Thus, the leading stock sheet can be securely positioned at the hopper outlet, and the degree of storage of the stock sheets between the second delivery position and the hopper outlet can be kept constant. Even though the draw-out means draws out the stock sheets at a higher speed, therefore, it can steadily draw them out one after another through the hopper outlet.

If the degree of storage of the stock sheets detected by the first detecting means becomes lower than a predetermined value, the control means actuates the first delivery means, thereby delivering the sheets toward the hopper outlet side or the second delivery position. Thus, the stock sheets are resupplied toward the hopper outlet. In consequence, the second delivery means can fulfill the aforesaid function with reliability.

The control means actuates the first and second delivery means for predetermined periods of time set individually for the first and second delivery means. More specifically, the first and second delivery means deliver a given number of stock sheets toward the hopper outlet when the degrees of storage of the stock sheets are lower than the predetermined values, respectively.

Specifically, the first delivery means includes a first delivery roller rotatable arranged at the first delivery position, and the first delivery roller has an outer peripheral surface that slightly projects from a bottom of the hopper. As the first delivery roller rotates, the lower end edge of each stock sheet is pushed out toward the hopper outlet. Preferably, the first delivery roller has grooves formed on its outer peripheral surface, and the grooves extend in the axial direction of the first delivery roller and has a width greater than the thickness of each stock sheet. As the first delivery roller rotates, in this case, each sheet engages one of the grooves on the outer peripheral surface of the roller, and is securely pushed toward the hopper outlet.

The first delivery means may further include an upper guide located over the first delivery roller. The upper guide has an upstream portion extending from the upstream side of the first delivery roller to the first delivery roller and a downstream portion extending from the upstream portion close to the hopper outlet. The distance between the first delivery roller and the boundary between the upstream and downstream portions is a little shorter than the height of each stock sheet. Preferably, the downstream portion of the upper guide has a downward groove adjacent to the boundary. When each stock sheet is delivered toward the hopper outlet as the first delivery roller rotates, the boundary between the upstream and downstream portions of the upper guide temporarily restrains the delivery of the upper end edge of the sheet. Accordingly, the lower end edge of the stock sheet is securely fitted in one of the grooves of the first delivery roller. When the lower end edge of the stock sheet gets over the first delivery roller, thereafter, the upper end edge of the sheet can get into the groove of the upper guide.

The second delivery means includes a second delivery roller rotatable arranged at the second delivery position, and the second delivery roller has an outer peripheral surface slightly projecting from the bottom of the hopper. Preferably, the second delivery roller has a smooth outer peripheral surface. As the second delivery roller rotates, in this case, each stock sheet is delivered toward the hopper outlet by utilizing frictional resistance between the outer peripheral surface of the second delivery roller and the lower end edge of the sheet.

The first detecting means may include a plurality of sensors for detecting the side edges of the stock sheets, while the second detecting means may include a sensor for detecting a gap between the hopper outlet and the leading stock sheet.

The hopper means may further include a stopper member located near to the receiving member in the hopper outlet. The stopper member can engage with the upper end edge of the leading stock sheet. On reaching the hopper outlet, the leading stock sheet is pressed against the stopper member and the receiving member, respectively, so that the upper portion of the leading stock sheet is compulsorily deformed into a specific curved shape that projects toward the hopper outlet. As a result, a warp of the leading stock sheet is removed, so that the suction pad of the draw-out means can securely attract the leading stock sheet by suction.

The hopper means may further include resisting means for applying a draw-out resistance to the stock sheets at the hopper outlet. Specifically, the resisting means may include side claws, located individually on the opposite sides of the hopper outlet and in contact with the opposite side edges of the stock sheets, and a lower claw in the form of an ascending stair located on the bottom edge of the hopper outlet and in contact with the lower end edges of the stock sheets. Although the leading stock sheet is drawn out getting over the side claws and the lower claw, these claws prevent succeeding stock sheets from being drawn out with the leading stock sheet. Thus, the stock sheets can be securely drawn out one after another through the hopper outlet.

The draw-out means may include a central suction pad for attracting the central portion of the leading stock sheet and side suction pads for attracting the opposite end portions of the leading stock sheet. The side suction pads draw out the opposite end portions of the leading stock sheet from the hopper outlet in advance of the central suction pad. When the leading stock sheet is drawn out, therefore, its opposite end portions first separate from a directly succeeding stock sheet. As this is done, air is allowed to get into the space between these two adjacent sheets, thereby preventing them from adhering to each other.

Further, the draw-out means may include air blow means for blowing air against the stock sheets in the vicinity of the hopper outlet from either side. This air blow means causes air compulsorily to flow between the leading stock sheet and the directly succeeding stock sheet, thereby helping these two sheets separate from each other.

Further scopes of applicability of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Packaging System

Figure 1:
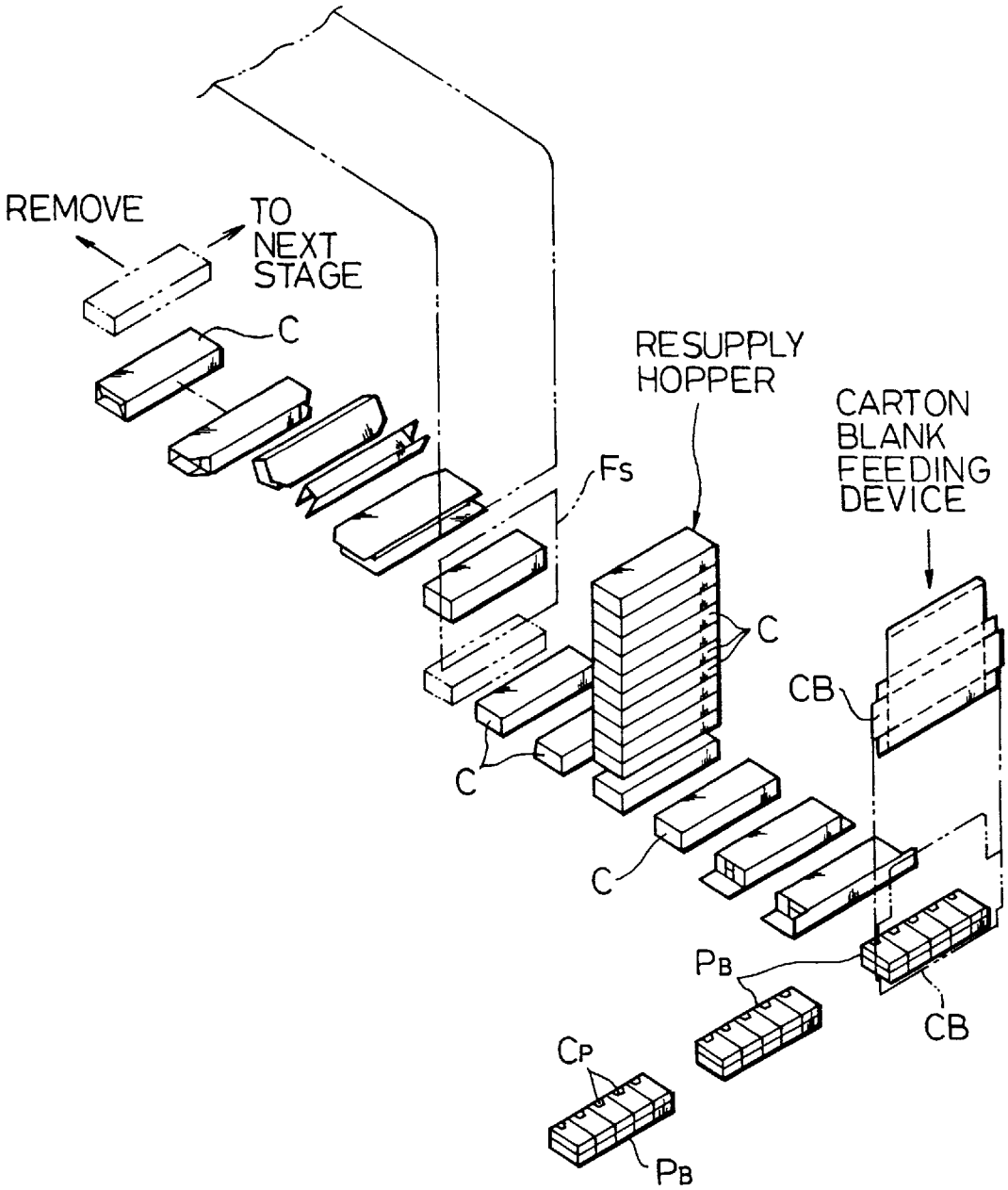
FIG. 1 is a schematic view showing a packaging system for loading cartons with cigarette packs.

Referring to FIG. 1, there is schematically shown a packaging system for cigarette packs. Each pack block $P_B$ is formed of two rows of cigarette packs $C_P$ stacked in layers, upper and lower, each row including five packs. As the cigarette packs $C_P$ are transported in this form, they are supplied with a carton blank $C_B$, and the pack block $P_B$ is wrapped in the blank $C_B$. A ten-pack carton C is obtained in this manner. In a subsequent transportation stage, the carton C is supplied with a f ilm sheet $F_S$ to be wrapped therein, whereupon packaging the carton C is completed. Finished cartons C are inspected, and those cartons C which are concluded to be defective as the result of the inspection are removed from the path of transportation. Thus, only non-defective cartons C are further transported to be delivered to the next stage. A resupply hopper is located over the transportation path for the cartons C as in FIG. 1, and the cartons C are stacked in layers in this hopper.

Feeding Device for Carton Blank

Figure 2:
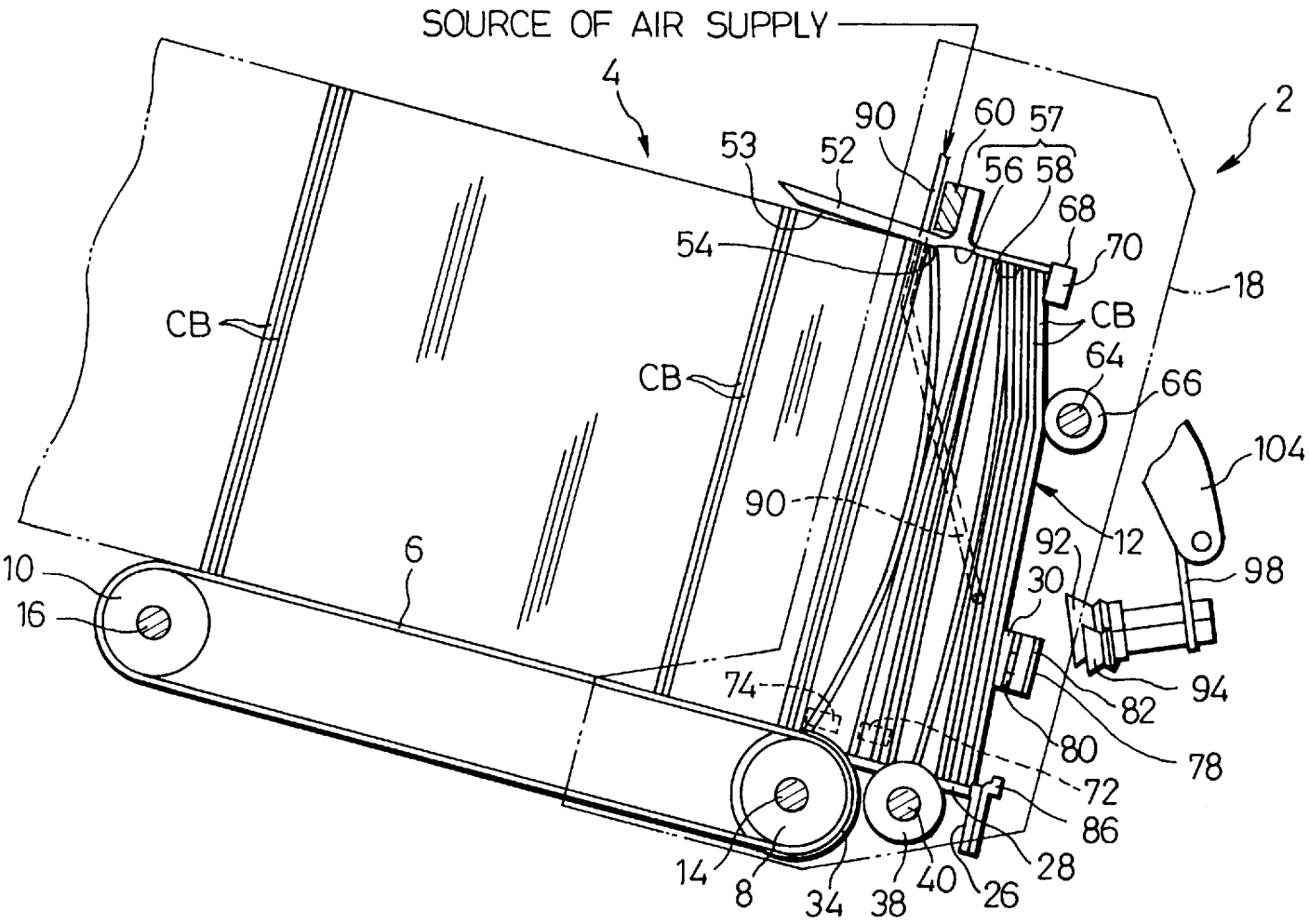
FIG. 2 is a schematic vertical sectional view showing part of a carton blank feeding device.
Figure 3:
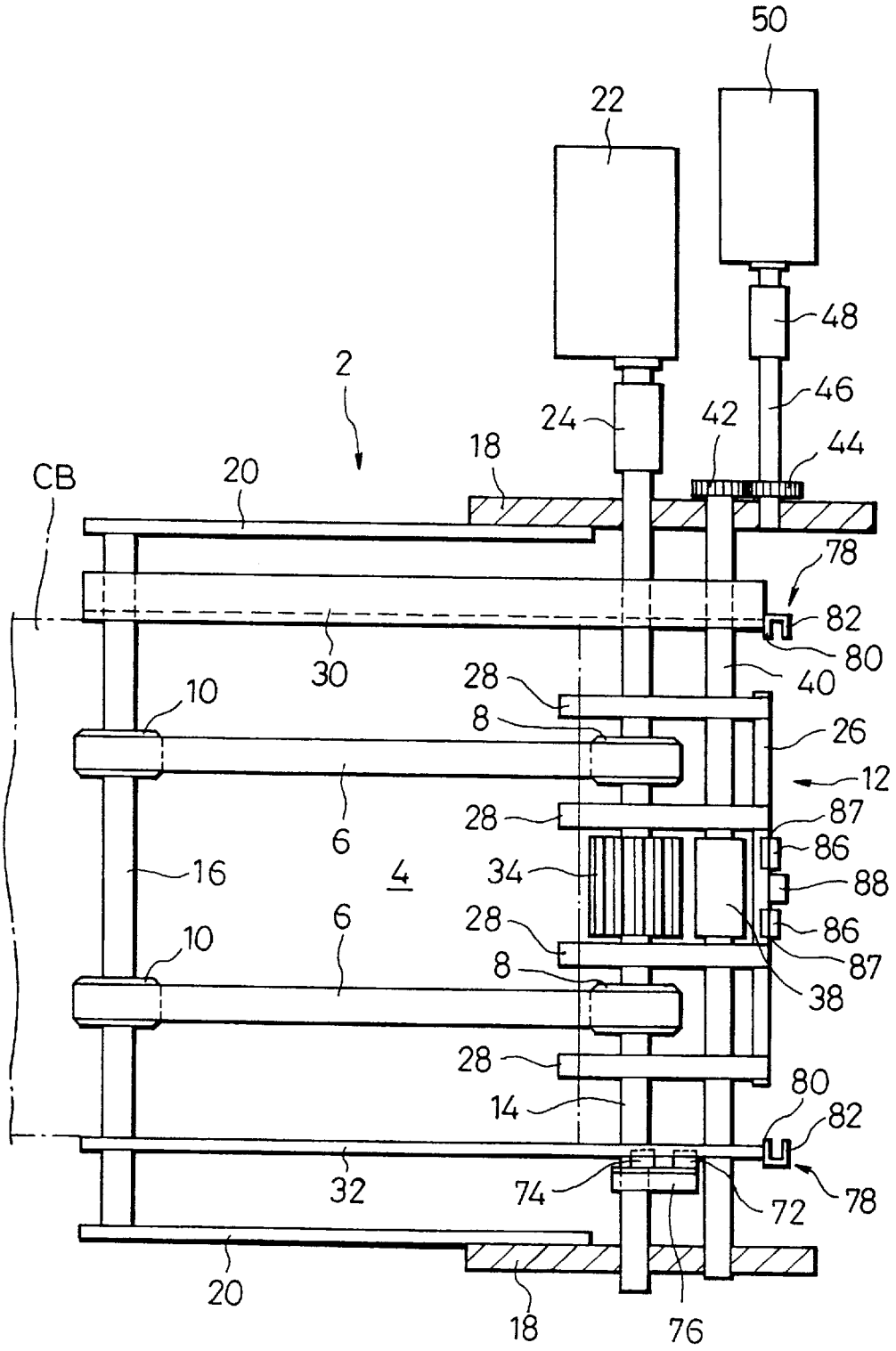
FIG. 3 is a cross-sectional view of a hopper shown in FIG. 2.
Figure 4:
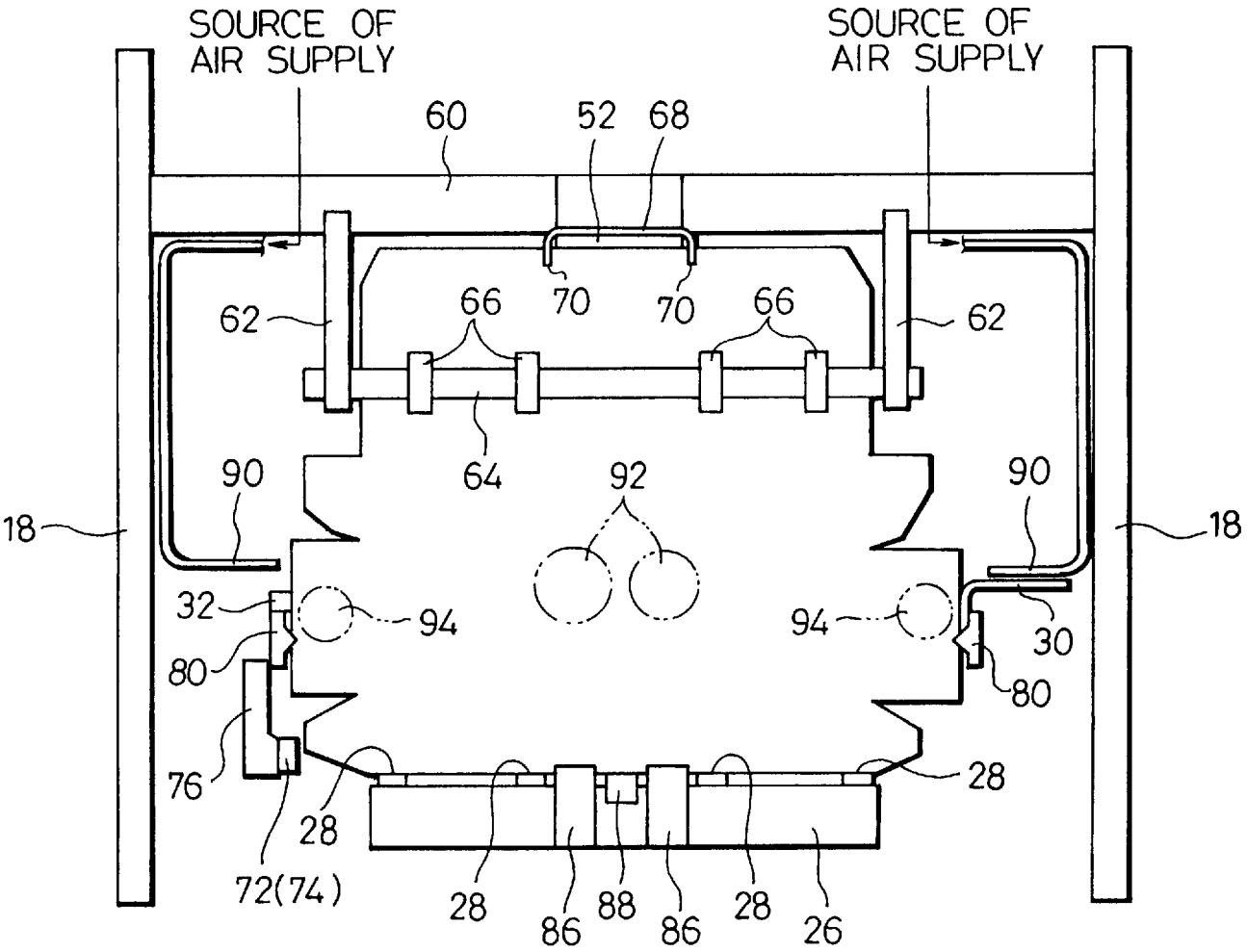
FIG. 4 is a front view of the hopper of FIG. 2.

Referring to FIGS. 2 to 4. there is shown a feeding device 2, which comprises a hopper 4. A large number of carton blank $C_B$ are stored upright in the hopper 4.

The hopper 4 has a movable bottom, which has a pair of feed belts 6, right and left. These belts 6 are arranged parallel to each other and extend toward a hopper outlet 12. Each belt 6 is passed around and between a driving roller 8 on the outlet side and a driven roller 10 on the upstream side. As seen from FIG. 2, the feed belts 6 are inclined at an angle of, e.g., 30° to a horizontal plane, and the hopper outlet 12 opens downward. On the other hand, an inlet of the hopper 4 is connected to a transportation path (not shown), and the upright carton blanks $C_B$ are fed successively into the hopper 4 through the transportation path.

As seen from FIG. 3, the driving roller 8 and the driven roller 10 for each of the right and left feed belts 6 are mounted on driving shaft 14 and a driven shaft 16, respectively. The respective opposite ends of these shafts 14 and 16 are supported for rotation on side frames 18 and 20 of the hopper 4, individually. The driving shaft 14 has one end projecting from its corresponding side frame 18, and the output shaft of a first stepping motor 22 is connected to the one end through a pad ring 24.

A fixed bottom, not a movable one, is provided between the hopper outlet 12 and the respective terminal ends of the right and left feed belts 6. Specifically, the fixed bottom includes a cross frame 26, which defines the bottom edge of the outlet 12, and four base plates 28 extending parallel to the belts 6 from the frame 26. The base plates 28 extend beyond the driving shaft 14. More specifically, each driving roller 8 is located between each corresponding pair of base plates 28. Thus, the feed belts 6 and the base plates 28 overlap one another as viewed in the feeding direction for the carton blanks $C_B$.

The hopper 4 has side guides 30 ad 32, which extend along the feed belts 6 to the hopper outlet 12. The distance between the side guides 30 and 32 is adjusted according to the size of the carton blanks $C_B$ to be stored in the hopper 4. Thus, the blanks $C_B$, held upright in the hopper 4, have their respective opposite side edges guided by the guides 30 and 32. More specifically, the side guides 30 and 32 guide the respective lower portions of the opposite side edges of each carton blank $C_B$, as shown in FIG. 4.

Each carton blank $C_B$ is obtained by being stamped out into a predetermined shape from a paperboard. As seen from FIG. 4, therefore, a plurality of folding flaps for assembling the blank $C_B$ into a box are formed on the outer periphery of each blank $C_B$. Each folding flap has a folding line that facilitates folding operation.

Referring again to FIG. 3, the driving shaft 14 is fitted with a delivery roller 34. The roller 34 is located between the right and left driving rollers 8, that is, between the two base plates 28. When the paired feed belts 6 are driven, the roller 34 is rotated in synchronism with them. The delivery roller 34 may be mounted on a driving shaft separate from the shaft 14.

Figure 5:
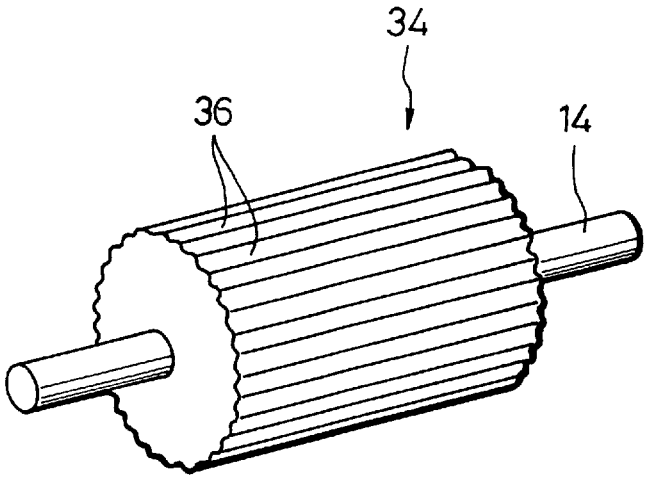
FIG. 5 is an enlarged perspective view of a delivery roller.

As seen from FIG. 2, the outer peripheral surface of the delivery roller 34 slightly projects from the bottom of the hopper 4, that is, from the feed belts 6 and the base plates 28. As shown in FIG. 5, the outer peripheral surface of the roller 34 has a large number of grooves 36, which may be formed by knurling. The grooves 36 extend in the axial direction of the roller 34, and are arranged at regular intervals in the circumferential direction of the roller 34. Each groove 36 has a width greater than the thickness of each carton blank $C_B$, and can engage the lower end edge of each blank $C_B$. The thickness of each blank $C_B$ is 0.35 mm or thereabout, for example. The grooves 36 may be replaced with a large number of projections or a frictional-engagement layer on the outer peripheral surface of the delivery roller 34, which can securely engage the respective lower end edges of the carton blanks $C_B$.

Further, an auxiliary roller 38 is provided between the delivery roller 34 and the hopper outlet 12. The roller 38 is mounted on a roller shaft 40. The shaft extends parallel to the driving shaft 14, and its opposite end portions are supported for rotation on the side frames 18, individually. The roller shaft 40 has one end that projects from its corresponding side frame 18 and is connected to a joint shaft 46 through gears 42 and 44. One end of the joint shaft 46 is rotatably supported on the side frame 18, while the other end is connected to a second stepping motor 50 through a pad ring 48.

The outer peripheral surface of the auxiliary roller 38, like that of the delivery roller 34, slightly projects from the bottom of the hopper 4, that is, from the base plates 28. Unlike the roller 34, however, the roller 38 has a smooth outer peripheral surface.

As shown in FIG. 2, an upper guide 52 is located over the hopper 4. The guide 52 extends from the upstream side of the delivery roller 34 to a position just short of the hopper outlet 12. The underside of the guide 52 includes a rear surface 53 and a front surface 57 in the feeding direction for the carton blanks $C_B$. While the rear surface 53, like the bottom of the hopper 4, is inclined downward, its inclination is a little greater than that of the bottom of the hopper 4. More specifically, the distance between the rear surface 53 and each feed belt 6 is gradually reduced toward the delivery roller 34. The rear and front surfaces 53 and 57 are divided by a boundary edge 54. The distance between the edge 54 and each feed belt 6 is equal to the height of each carton blank $C_B$.

The front surface 57 of the upper guide 52 includes an upward arcuate groove 56 continuous with the boundary edge 54 and a flat surface 58 smoothly continuous with the groove 56. The arcuate groove 56 is situated over the delivery roller 34 and extends in the axial direction of the roller 34. The flat surface 58 is parallel to the bottom face of the hopper 4, and the distance between the surface 58 and the bottom of the hopper 4 is a little greater than the height of each carton blank $C_B$. As shown in FIG. 4, the upper guide 52 is situated in the center of hopper outlet 12 with respect to the width direction thereof, and is mounted on a cross frame 60. The frame 60 connects the right and left side frames 18 of the hopper 4.

A pair of arms 62, right and left, are mounted on the cross frame 60, and extend diagonally downward to the hopper outlet 12. The opposite ends of a roller shaft 64 are supported individually by the respective lower ends of the arms 62, and four backup rollers 66 are rotatably mounted on the shaft 64. As seen from FIG. 4, the distance between the arms 62 is greater than the width of the upper portion of each carton blank $C_B$. The backup rollers 66 are situated at a height corresponding to the upper portion of the blank $C_B$.

As shown in FIG. 2, a crossbar 68 is attached to the front end of the upper guide 52. The crossbar 68 extends in the width direction of the hopper outlet 12, and its opposite ends are bent downward. Thus, the opposite ends of the crossbar 68 project downward into the hopper 4, forming a pair of stoppers 70 for the carton blanks $C_B$.

As seen from FIG. 2, the stoppers 70 are situated near to the backup rollers 66 in the hopper 4, and a predetermined distance is secured between the rollers 66 and the stoppers 70.

As shown in FIG. 3, a pair of gap sensors 72 and 74 are attached to the side guide 32 by means of a mounting plate 76. These gap sensors 72 and 74 are reflector-type photoelectric sensors, for example. As seen from FIG. 2, the sensors 72 and 74 are spaced in the feeding direction for the carton blanks $C_B$. The one gap sensor 72 is located between the delivery roller 34 and the auxiliary roller 38 in the carton blank feeding direction. The other gap sensor 74 is located in a position slightly deviated from the axis of the delivery roller 34 on the side of the auxiliary roller 38. The gap sensors 72 and 74 emit detection lights toward the respective lower portions of the side edges of carton blanks $C_B$ in the hopper 4, and receive reflected lights from the lower portions of the side edges. Based on the quantities of the received reflected lights, the sensors 72 and 74 output detection signals corresponding to the degree of storage or density of the carton blanks $C_B$.

Figure 6:
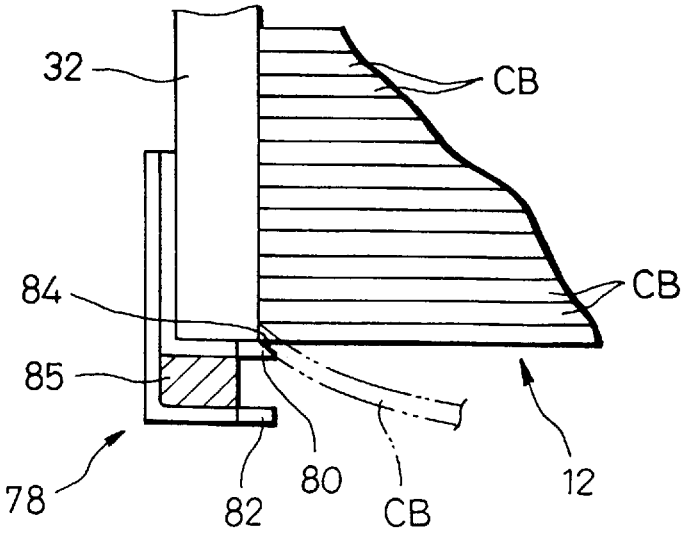
FIG. 6 is a plan view of one side claw.

Further, double side claws 78 are attached individually to the respective front ends of the side guides 30 and 32. The one double side claw 78 is shown in the enlarged views of FIGS. 6 and 7. The claw 78 includes an inner claw 80 at the hopper outlet 12 and an outer claw 82 outside the outlet 12. Each of the claws 80 and 82 is formed on one end of an L-shaped plate member. The two L-shaped plate members are jointly fixed to the outer surface of the side guide 32. The respective tip ends of the inner and outer claws 80 and 82 slightly project from the inner surface of the guide 32, that is, from a guide surface for the carton blanks $C_B$. The respective projections of the claws 80 and 82 have the same length.

Figure 7:
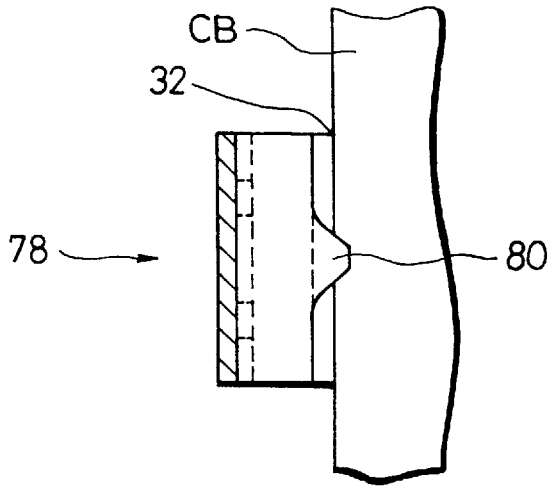
FIG. 7 is a front view showing an inner claw of the side claw.

As shown in FIG. 7, the inner claw 80 has a triangular shape, only its vertex portion projects from the guide surface of the side guide 32. As seen from FIG. 6, moreover, the tip end of the inner claw 80 is cut aslant so that it has a slanting surface 84 that is continuous with the guide surface of the guide 32. The outer claw 82 is formed of the straight end edge of corresponding L-shaped plate member or, like the inner claw 80, has a triangular shape. A filler member 85 is located between the inner and outer claws 80 and 82. Even though a side edge of the carton blank $C_B$ gets into the space between the claws 80 and 82, therefore, its invasion is restricted by the filler member 85.

Figure 8:
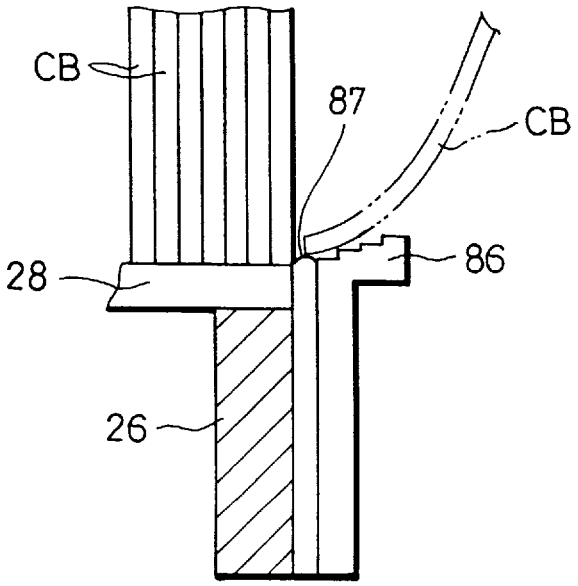
FIG. 8 is a side view showing a stepped claw.

As shown in FIG. 3, a pair of stopper claws 87, right and left, are attached to the front face of the cross frame 26. These stopper claws 87 are arranged in the central region of the hopper outlet 12 with respect to the width direction thereof. Further, a stepped claw 86 is attached to each stopper claw 87 in an overlapping manner. Each of the claws 87 and 86 is formed of the upper end of a plate member. The claws 87 and 86 slightly project from the bottom of the hopper 4. More specifically, each stopper claw 87 has a semicircular profile, while the upper surface of each stepped claw 86 has the shape of an ascending stair, as shown in FIG. 8. The stopper claw 86 slightly projects above the lowest tread of the stepped claw 86.

Moreover, an arrival sensor 88 (see FIG. 3 or 4) is attached to the cross frame 26 so as to be situated between the paired stepped claws 86. The sensor 88, like the gap sensors 72 and 74, may be formed of a reflector-type photoelectric sensor. The arrival sensor 88 emits a detection light toward the leading carton blank $C_B$ in the hopper 4, and receives a reflected light from the blank $C_B$. After detecting the reflected light, the sensor 88 outputs a detection signal corresponding to the distance between itself and the leading carton blank $C_B$, in accordance with the received reflected light.

As shown in FIG. 4, air blow pipes 90 are arranged individually over the pair of side guides 30 and 32. An open end of each pipe 90 is directed to its corresponding side edges of the carton blanks $C_B$ in the hopper 4. More specifically, the open end of each air blow pipe 90 is situated in the center of the blanks $C_B$ with respect to the height direction thereof. With respect to the feeding direction for the carton blanks $C_B$, on the other hand, the open end of each pipe 90 is situated between the auxiliary roller 38 and the hopper outlet 12, as indicated by broken line in FIG. 2. Each air blow pipe 90 is connected to a source of air supply, and can jet out air through its open end as it is supplied with air from the air source.

As shown in FIG. 2, first and second pairs of suction pads 92 and 94 are arranged opposite the front of the hopper outlet 12. The first pair of suction pads 92 are situated in the central region of the outlet 12 with respect to the width direction thereof. The second pair of suction pads 94 are positioned outside the first suction pads 92, individually. The second pads 94 are situated on a level just below the first pads 92, and the first pads 92 project longer toward the hopper outlet 12 than the second pads 94. Further, each first suction pad 92 has a suction bore larger than that of each second suction pad 94. For example, the first and second pads 92 and 94 have suction bores of 40 mm and 30 mm, respectively. Referring to FIG. 4, the first and second pads 92 and 94 are clearly indicated by two-dot chain lines. The first pair of suction pads 92 face the central portion of the leading carton blank $C_B$, while the second pair of suction pads 94 are opposed individually to the opposite end portions of the blank $C_B$.

The first and second suction pads 92 and 94 are movable toward and away from the interior of the hopper 4 through the hopper outlet 12. This movement is caused by a drive mechanism 96, which is shown in detail in FIG. 9.

Figure 9:
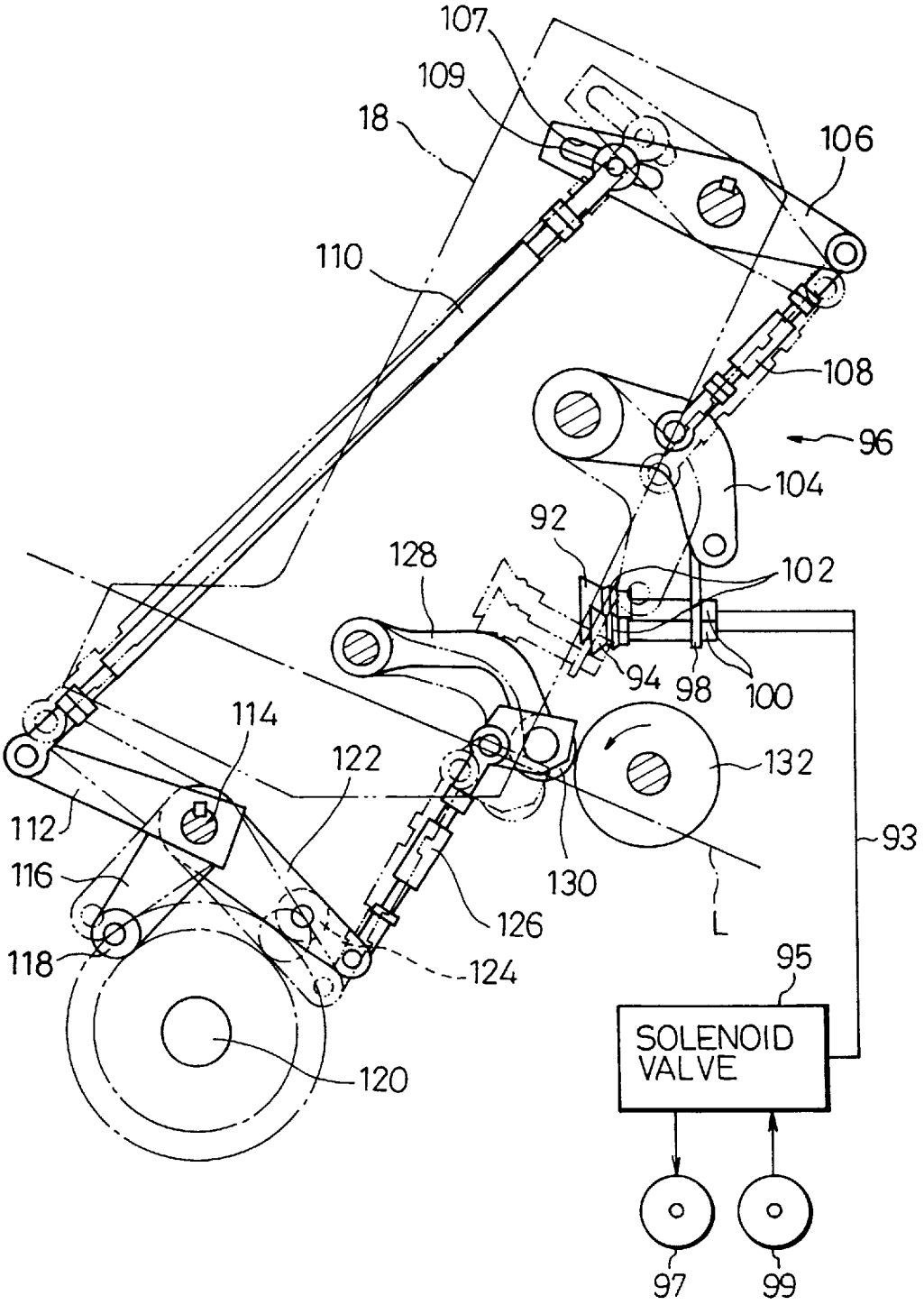
FIG. 9 is a schematic view showing a drive mechanism for first and second suction pads.

As seen from FIG. 9, the first and second suction pads 92 and 94 are supported on pad holders 100, individually. More specifically, each holder 100 includes a bellows 102, which is connected with its corresponding suction pad. Thus, each pad holder 100 supports the suction pad in a retractable manner with the aid of the bellows 100.

The pad holders 100 are mounted on a holder plate 98, which extends in the width direction of the hopper outlet 12. The opposite ends of the plate 98 are supported individually on the respective lower ends of a pair of rocking arms 104. The respective upper ends of the arms 104 are rockably supported on their corresponding side frames 18.

A pair of seesaw arms 106 are arranged over the rocking arms 104, and are also rockably supported on their corresponding side frames 18. Each rocking arm 104 is connected to one end of its corresponding seesaw arm 106 by means of a link rod 108.

A slot 107 is formed in the other end of each seesaw arm 106, and a pin 109 is slidably fitted in the slot 109. The upper end of a link rod 110 is rotatably connected to the corresponding pin 109. The link rods 110 extend to a level below the bottom of the hopper 4. In FIG. 9, the bottom face of the hopper 4 is indicated by a dashed line L.

The lower end of each link rod 110 is rotatably connected to one end of a swing arm 112. The other end of the arm 112 is mounted on a support shaft 114. The shaft 114 extends in the width direction of the hopper 4, and its opposite ends are rotatably supported on their corresponding side frames 18.

A pair of driving arms 116 extend from the support shaft 114, and roller-type cam followers 118 are mounted individually for rotation on the respective distal ends of the arms 116. Each cam follower 118 is fitted in a grooved cam or cam groove. In FIG. 9, the grooved cam is not shown in a definite form, though its maximum and minimum diameters are indicated individually by dashed-line circles. Thus, the distance between the maximum and minimum circles represents the maximum lift of each cam follower 118.

The grooved cams are mounted on a rotating shaft 120, the opposite ends of which are supported individually for rotation on the side frames 18. One end of the shaft 120 is connected to a drive source (not shown). When the grooved cams are rotated together with the shaft 120, they cooperate with the cam followers 118 to swing the driving arms 116 for reciprocation. The swinging motions of the arms 116 are transmitted to the rocking arms 104 through the swing arms 112, link rods 110, seesaw arms 106, and link rods 108, individually, whereupon they are converted into rocking motions of the rocking arms 104. As a result, the first and second suction pads 92 and 94 describe circular arcs as they move toward and away from the hopper outlet 12.

A pair of driving arms 122 are rotatably mounted on the support shaft 114. These arms 122 and the swing arms 112 extend in opposite directions. Roller-type cam followers 124 are mounted individually for rotation on the respective distal ends of the driving arms 122. The cam followers 124, like the aforesaid cam followers 118, are fitted in the cam grooves of their corresponding grooved cams. Each cam follower 124 may be fitted in the cam groove of another grooved cam that is mounted on the rotating shaft 120.

Link rods 126 extend upward from the respective distal ends of the driving arms 122, individually. The upper end of each link rod 126 is connected to the distal end portion of each corresponding swing arm 128 by means of a connecting plate. The proximal end of each swing arm 128 is rockably supported on its corresponding side frame 18. The opposite ends of a roller shaft are supported individually for rotation by the respective distal ends of the arms 128, and a pinch roller 130 is mounted on the roller shaft. The pinch roller 130 is situated in front of the hopper outlet 12. Further, a feed roller 132 is provided for rotation in front of the pinch roller 130. The roller 132 is situated under the first and second suction pads 92 and 94, and is rotated in the counterclockwise direction as shown in FIG. 9. The feed roller 132 can receive a rotatory force from the same drive source for the rotating shaft 120. As seen from FIG. 9, the axis of the roller 132 is located above the extension line L of the bottom face of the hopper 4.

When the grooved cams are rotated, they cooperate with the cam followers 124 to rock the pair of driving arms 122. The respective rocking motions of the arms 122 are converted into a reciprocative swinging motion of the pinch roller 130 by means of the link rods 126 and the swing arms 128. Thus, the pinch roller 130 cyclically comes into rolling contact with the feed roller 132. In the state shown in FIG. 9, the rollers 130 and 132 are in rolling contact with each other, and the first and second suction pads 92 and 94 are situated outside the hopper outlet 12.

Further, the first and second suction pads 92 and 94 are connected individually to suction hoses 93. These hoses 93 are connected alternatively to a negative-pressure source 97 or a compressed air source 99 through a solenoid valve 95.

Figure 10:
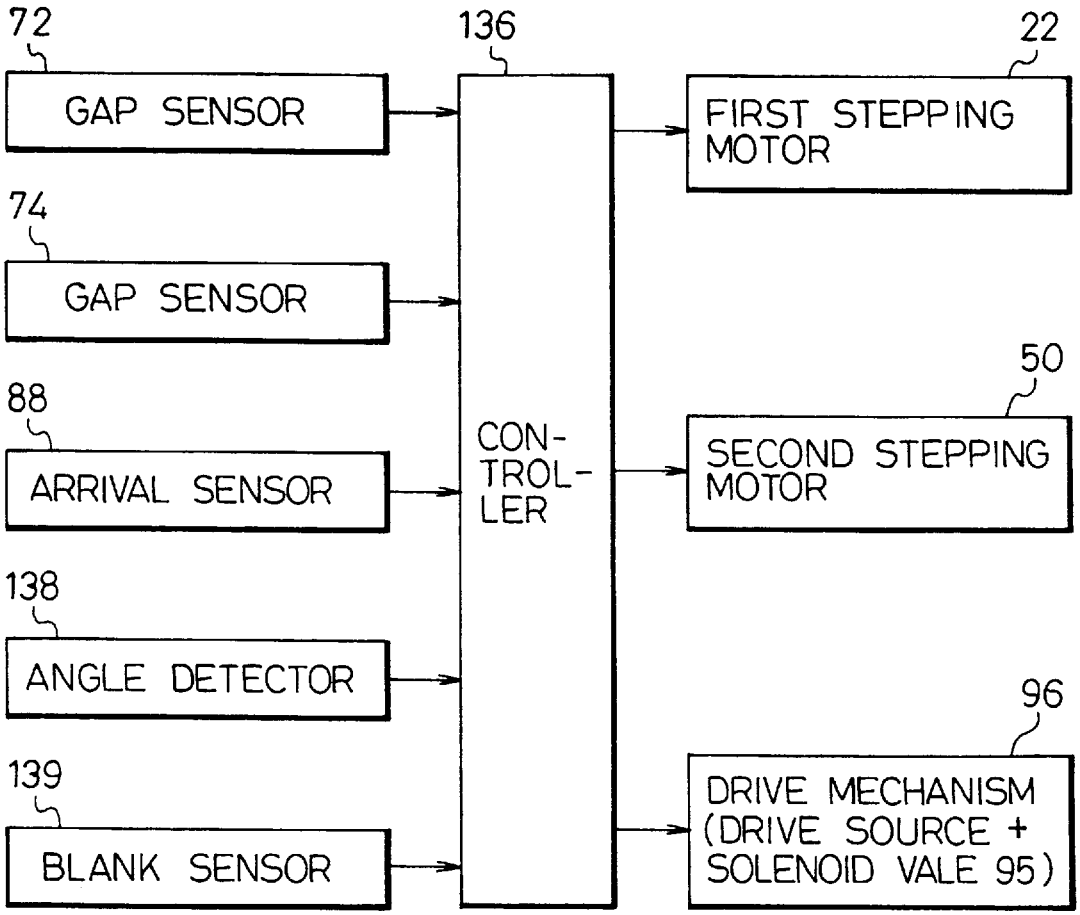
FIG. 10 is a circuit diagram showing a control circuit for controlling the feed of carton blanks.

As shown in FIG. 10, the drive mechanism 96 (including the drive source for the rotating shaft 120 and the solenoid valve 95) and the first and second stepping motors 22 and 50 are connected electrically to output ports of a controller 136, individually, and are controlled in operation in response to control signals from the controller 136. To attain this, input ports of the controller 136 are connected electrically with an angle detector 138 for detecting the rotational angle of the rotating shaft 120 of the drive mechanism 96 and a blank sensor 139, as well as the gap sensors 72 and 74 and the arrival sensor 88. The angle detector 138 is attached to a main shaft of the aforesaid drive source, and the controller 136 detects the rotational angle of the rotating shaft 120 in accordance with the rotational angle of the main shaft. The blank sensor 139 is located in the vicinity of the hopper outlet 12, and may be formed of a reflector-type photoelectric sensor, for example. When one of the carton blanks $C_B$ is drawn out from the hopper 4 by means of the first and second suction pads 92 and 94, the blank sensor 139 detects the drawn-out blank $C_B$, and delivers a detection signal to the controller 136.

Figure 11:
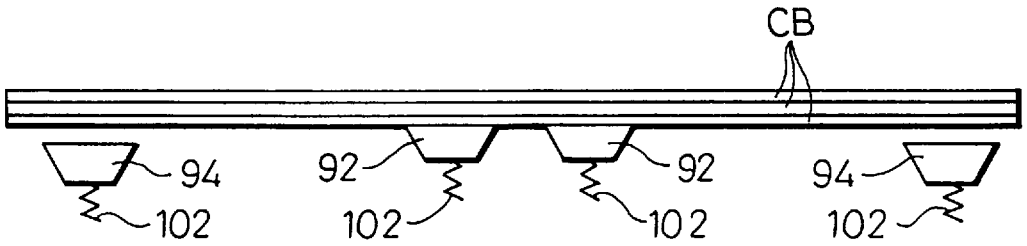
FIGS. 11, 12 and 13 are views showing the way a carton blank is drawn out by means of the suction pads.
Figure 12:
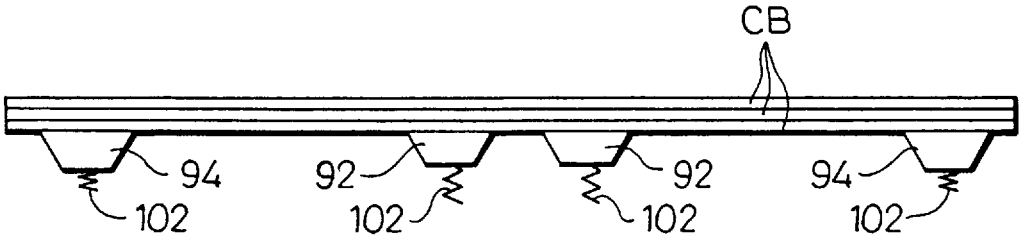
Figure 13:
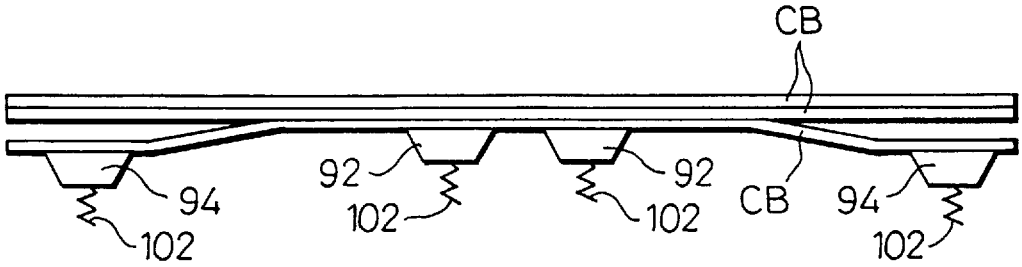

FIGS. 11, 12 and 13 show the way the carton blank $C_B$ is drawn out by means of the first and second suction pads 92 and 94. Prior to the description of this operation to follow, let it first be supposed that the carton blanks $C_B$ are stored upright in the hopper 4, and that the leading carton blank $C_B$ is at the hopper outlet 12, as shown in FIG. 2. At this time, air from the pair of air blow pipes 90 is blown against both side edges of the carton blanks $C_B$.

In this state, the drive mechanism 96 is actuated to move the first and second suction pads 92 and 94 from the position shown in FIG. 9 toward the hopper outlet 12, as indicated by two-dot chain line. Thereupon, the pinch roller 130 moves away from the feed roller 132 to the position indicated by two-dot chain line, in which is situated below the extension line L of the bottom face of the hopper 4. Thus, a space for the carton blank $C_B$ is secured between the rollers 130 and 132.

As mentioned before, the first suction pads 92 project longer toward the hopper outlet 12 than the second suction pads 94. Accordingly, the first pair of pads 92 first abut against the leading carton blank $C_B$ in the hopper 4, as shown in FIG. 11, and thereafter, the second pair of pads 94 also abut against the leading blank $C_B$, as shown in FIG. 12. As this is done, the bellows 102 of the pad holders 100 are contracted. The bellows 102 corresponding to the first suction pads 92 are contracted to a higher degree than the ones corresponding to the second suction pads 94, whereby the difference between the projections of the first and second suction pads 92 and 94 is absorbed.

Before the first and second suction pads 92 and 94 abut against the leading carton blank $C_B$, the controller 136 switches the solenoid valve 95 in accordance with an output signal from the angle detector 138, thereby causing the pads 92 and 94 to be connected to the negative-pressure source 97. Thus, the moment the first and second suction pads 92 and 94 abut against the leading carton blank $C_B$, they can attract lower portions of the blank $C_B$, in the center and on the opposite sides thereof, respectively. Preferably, the timing for the supply of negative pressure to the pads 92 and 94 should be varied depending on the operating speed of the drive mechanism 96, that is, the moving speeds of the pads.

Thereafter, the second suction pads 94 start to return from the hopper outlet 12 in advance of the first suction pads 92. As shown in FIG. 13, therefore, the opposite end portions of the leading carton blank $C_B$ are first drawn out from the hopper outlet 12 by the second pads 94, and subsequently, the lower central portion of the blank $C_B$ is drawn out by the first pads 92. As a result, the leading carton blank $C_B$ separates from its successor, starting at its opposite end portions, whereupon air is allowed to be introduced into the gap between the two adjacent carton blanks $C_B$. Since air is blown out from the pair of air blow pipes 90 toward the opposite side edges of blanks $C_B$, moreover, it can be caused securely to get into the gap between the leading carton blank $C_B$ and its successor. As the leading blank $C_B$ is drawn out by the first suction pads 92, therefore, it can be separated satisfactorily from the succeeding carton blank $C_B$.

When the lower part of the leading carton blank $C_B$ is drawn out from the hopper outlet 12, the opposite side edges of the blank $C_B$ engage the aforesaid side claws 78, individually. Thus, the lower portions of the opposite side edges of the leading blank $C_B$ are elastically deformed as indicated by two-dot chain line in FIG. 6, respectively, by engaging with their corresponding inner claws 80. This elastic deformation enables the blank $C_B$ to get over the inner claws 80. Thereafter, the opposite side edges of the leading carton blank $C_B$ further engage with their corresponding outer claws 83 to be elastically deformed thereby. This elastic deformation enables the blank $C_B$ to get over the outer claws 82 and be drawn out from the hopper outlet 12. The sucking force of the second pair of suction pads 94 to attract the leading carton blank $C_B$ can satisfactorily overcome resistances from the side claws 78 against the delivery of the blank $C_B$.

Each inner claw 80 has a triangular shape, as seen from FIG. 7, and is formed with the slanting surface 84 (see FIG. 6) on its tip end. Thus, each carton blank $C_B$ can get over the inner claws 80. When the succeeding carton blank $C_B$ is urged to be drawn out, closely following the leading carton blank $C_B$, however, the presence of the inner claws 80 constitutes a resistance great enough to prevent the succeeding blank $C_B$ from being drawn out. Accordingly, the succeeding blank $C_B$ cannot be drawn out together with the leading one, that is, the carton blanks $C_B$ can be securely drawn out one after another.

When the leading carton blank $C_B$ is drawn out, moreover, its lower end edge is also subjected to draw-out resistances from the stopper claws 87 and the stepped claws 86. As the lower end portion of the leading blank $C_B$ engages with the claws 87 and 86 in succession, therefore, the blank $C_B$ is elastically deformed, as indicated by two-dot chain line in FIG. 8, and is drawn out from the hopper outlet 12, getting over claws 87 and 86. It is to be understood that the sucking force of the first pair of suction pads 92 to attract the leading carton blank $C_B$ is greater enough than the draw-out resistances from the stopper claws 87 and the stepped claws 86.

When the succeeding carton blank $C_B$ is urged to be drawn out together with the leading carton blank $C_B$, the stopper claws 87 prevent it from being drawn out. Even in case the lower end edge of the succeeding blank $C_B$ gets over the claws 87, it is subjected to the draw-out resistance from the succeeding stepped claws 86, so that the succeeding blank $C_B$ can be securely prevented from being drawn out. More specifically, the upper end face of each stepped claw 86 has the shape of an ascending stair, so that the lower end edges of the succeeding blanks $C_B$ are subjected to loosening operation by the stepped claws 86. Thus, each succeeding carton blank $C_B$ can never be drawn out together with each leading carton blank $C_B$. In consequence, the carton blanks $C_B$ can be securely prevented from being drawn out doubly.

When the first and second suction pads 92 and 94 return to the position shown in FIG. 9, the lower end edge of the carton blank $C_B$ attracted to these pads comes into contact with the feed roller 132. Also, the pinch roller 130 is returned to the position shown in FIG. 9, whereupon the lower end edge of the blank $C_B$ is sandwiched between the rollers 130 and 132.

At this point of time, the controller 136 switches the solenoid valve 95, thereby stopping the supply of negative pressure to the first and second suction pads 92 and 94 and allowing the pads 92 and 94 to be connected to the compressed air source 99. Thereupon, the first and second pads 92 and 94 are supplied with compressed air under a relatively low pressure from the air source 99, and blow out the compressed air against the carton blank $C_B$. In this manner, the blank $C_B$ can be separated satisfactorily from the pads 92 and 94.

Besides switching the solenoid valve 95, the controller 136 causes the feed roller 132 to rotate. The rotation of the roller 132 serves to feed the carton blank $C_B$ between the feed roller 132 and the pinch roller 132 downward. More specifically, the blank $C_B$ is fed downward to the transportation path for the pack blocks $P_B$ shown in FIG. 1, and is used to package one of the blocks $P_B$. The carton blanks $C_B$ are drawn out successively from the hopper 4 as the drive mechanism 96 is actuated repeatedly.

Figure 14:
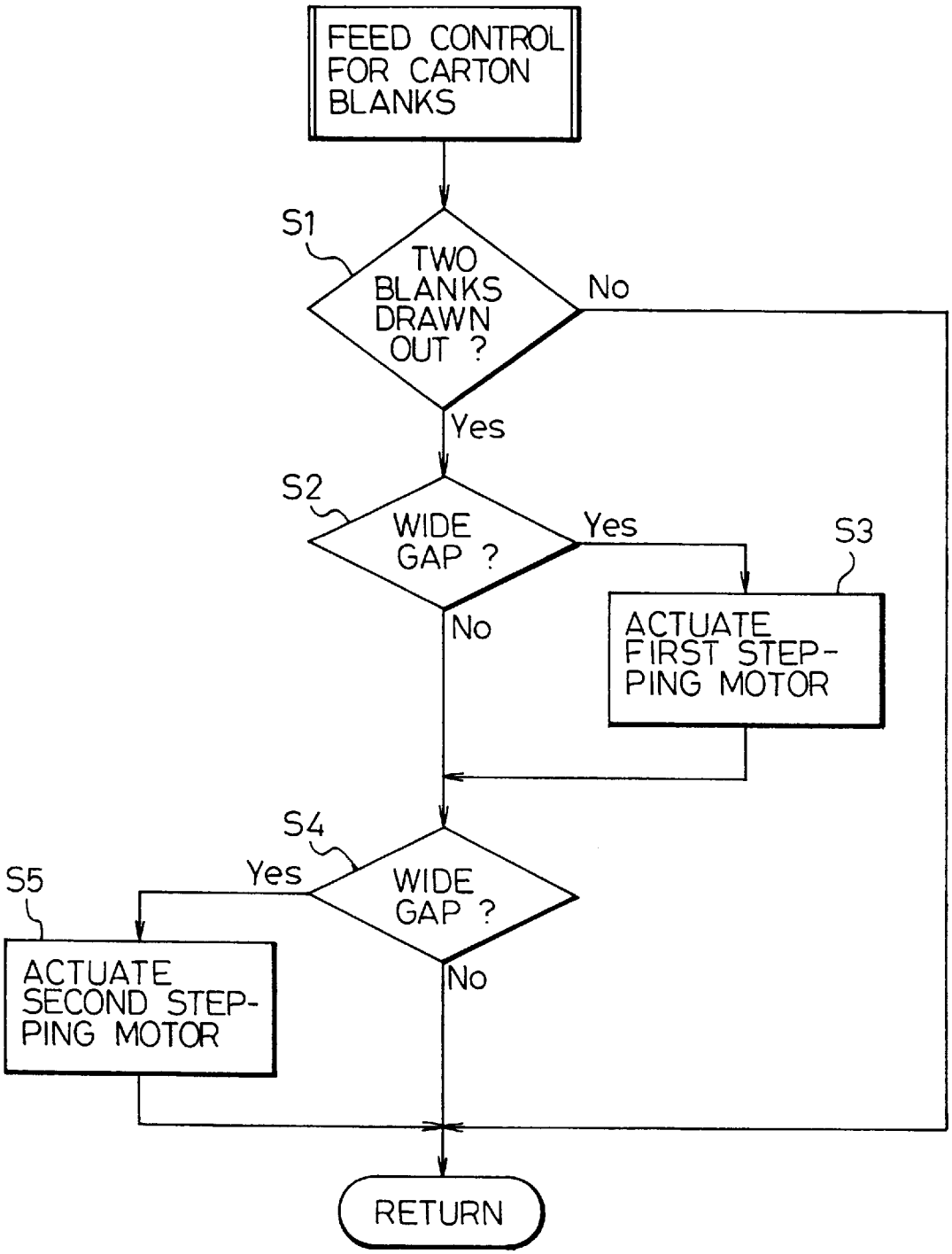
FIG. 14 is a flowchart showing a feed control routine executed by a controller.

Referring now to FIG. 14, feed control for the carton blanks $C_B$ in the hopper 4 will be described. This feed control is executed by means of the controller 136.

First, in Step S1, it is determined whether or not a plurality of carton blanks $C_B$, e.g., two in number, are drawn out from the hopper 4. More specifically, the controller 136 causes a counter to count the carton blanks $C_B$ drawn out from the hopper 4 in response to an output signal from the blank sensor 139. If the conclusion in Step S1 is No, the controller 136 repeatedly executes the discrimination process of Step S1.

If two carton blanks $C_B$ are drawn out from the hopper 4, that is, if the counter value is 2, the conclusion in Step S1 is Yes, whereupon the controller 136 resets the counter value, and then executes the next process of Step S2. In Step S2, the controller 136 determines whether or not the degree of storage of the carton blanks $C_B$ in the region between the delivery roller 34 and the hopper outlet 12 is lower than a predetermined value. More specifically, the controller 136 detects gaps between the carton blanks $C_B$ in accordance with output signals from the pair of gap sensors 72 and 74, and determines whether or not the size of one of the detected gaps is greater than a predetermined value. If the conclusion in Step S2 is Yes, the controller 136 actuates the first stepping motor 22, thereby running the pair of feed belts 6 and rotating the delivery roller 34 (Step S3). If the conclusion in Step S2 is No, on the other hand, the controller 136 executes the next process of Step S4 without executing Step S3.

Figure 15:
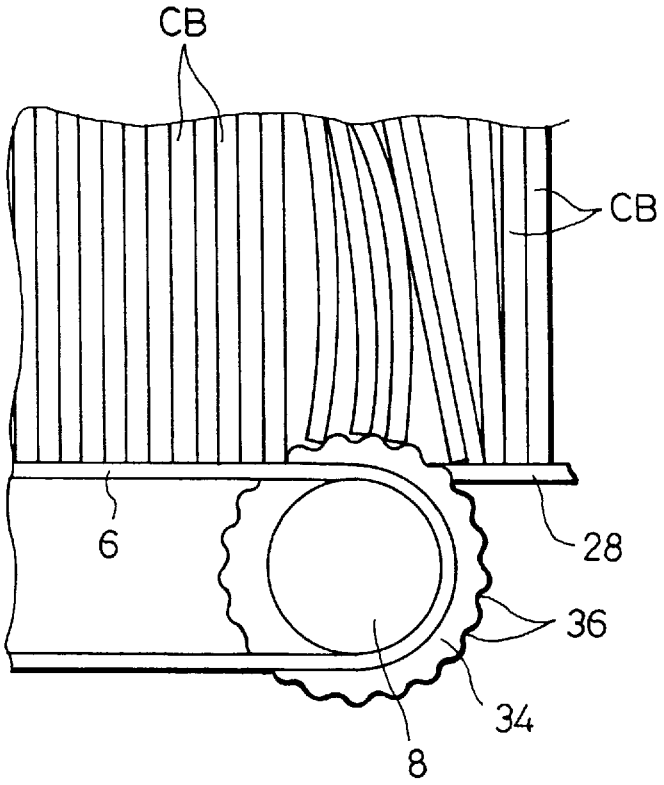
FIG. 15 is a view for illustrating the operation of the delivery roller.

When Step S3 is carried out, the feed belts 6 travel so that all the carton blanks $C_B$ thereon are transported toward the hopper outlet 12. As this is done, the carton blank $C_B$ having reached the outer peripheral surface of the delivery roller 34 is held between the boundary edge 54 of the upper guide 52 and the feed belts 6, whereupon the upper end edge of the blank $C_B$ ceases to be transferred. However, the lower end edge of the carton blank $C_B$ engages one of the grooves 36 (see FIG. 5) that are formed on the outer peripheral surface of the delivery roller 34. As the roller 34 rotates, therefore, the blank $C_B$ is fed toward the auxiliary roller 38. Thus, the lower end edge of each carton blank $C_B$ is elastically deformed as it gets over the delivery roller 34, as shown in FIG. 15, whereupon the blank $C_B$ is delivered toward the auxiliary roller 38. When the lower end edge of the blank $C_B$ entirely gets over the delivery roller 34, the blank $C_B$ is pushed out by another carton blank $C_B$ that follows it. Accordingly, the upper end edge of the blank $C_B$ runs off the boundary edge 54 of the upper guide 52, and advances into the arcuate groove 56.

Thus, as the delivery roller 34 rotates, the carton blanks $C_B$ are securely delivered one after another toward the auxiliary roller 38. In each cycle, the delivery roller 34 is rotated for a predetermined rotational angle just wide enough to deliver, e.g., about ten carton blanks $C_B$. The time required for this cycle of rotation is about 0.8 sec.

In Step S4, it is determined whether or not the degree of storage of the carton blanks $C_B$ between the auxiliary roller 38 and the hopper outlet 12 is lower than a predetermined value. More specifically, the controller 136 determines, in accordance with an output from the arrival sensor 88, whether or not the size of the gap between the sensor 88 and the leading carton blank $C_B$ is not smaller than a predetermined value. If the conclusion in Step S4 is Yes, the controller 136 actuates the second stepping motor 50 (Step S5). If the conclusion in Step S4 is No, the controller 136 repeatedly executes Step S1 and the subsequent steps.

When Step S5 is executed, the auxiliary roller 38 is rotated for a predetermined rotational angle, e.g., 60°. The time required for this rotation is about 0.8 sec. The rotation of the roller 38 causes the carton blanks $C_B$ nearby to be fed toward the hopper outlet 12, whereupon the leading carton blank $C_B$ is pushed by the succeeding carton blank $C_B$ and positioned at the outlet 12. The front face of the leading blank $C_B$ having reached the outlet 12 in this manner abuts against the backup rollers 66 (see FIG. 2).

As seen from FIG. 2, the pair of stoppers 70 are situated near the backup rollers 66 in the hopper 4. Accordingly, the upper end edge of the leading carton blank $C_B$ is restrained by the stoppers 70 from being fed, so that the respective upper portions of the carton blanks $C_B$ in the vicinity of the hopper outlet 12 are compulsorily warped so as to project toward the outlet 12. Even though the carton blanks $C_B$ themselves are warped in the opposite direction, therefore, their posture is corrected in the aforesaid manner when they come close to the hopper outlet 12.

According to the feed control routine described above, the gap between the leading carton blank $C_B$ in the hopper 4 and the arrival sensor 88 is detected every time two carton blanks $C_B$ are drawn out from the hopper 4. If the size of this gap is greater than the predetermined value, the auxiliary roller 38 is rotated, whereupon the leading carton blank $C_B$ is securely pushed out toward the hopper outlet 12 to be positioned therein. The carton blanks $C_B$ stored in the vicinity of the hopper outlet 12 are subjected to a fixed force of pressure from the auxiliary roller 38. Thus, even though the first and second suction pads 92 and 94 abut against the leading carton blank $C_B$, the blank $C_B$ can never be undesirably pushed into the hopper 4. Although the pads 92 and 94 move toward and away from the hopper outlet 12 at high speed, therefore, they never fail to attract the leading blank $C_B$ and draw it out securely from the outlet 12. In this manner, the operating speed of the feeding device can be increased.

As mentioned before, moreover, the leading carton blank $C_B$ is compulsorily kept in the fixed posture by the agency of the stoppers 70 and the backup rollers 66. This further ensures the attraction of the carton blank $C_B$ to the first and second suction pads 92 and 94, so that the blank $C_B$ can be drawn out with stability.

The degree of storage of the carton blanks $C_B$ in the vicinity of the delivery roller 34 is also detected every time two blanks $C_B$ are drawn out from the hopper 4. If the storage degree is lower than a predetermined value, the feed belts and the delivery roller 34 are actuated together, and the blanks $C_B$ get over the roller 34 and are securely delivered toward the auxiliary roller 38. Thus, the carton blanks $C_B$ can be steadily supplied toward the hopper outlet 12. Although the speed of drawing out the blanks $C_B$ from the hopper 4 is raised with the increase of the operating speed of the feeding device, in consequence, the degree of storage of the blanks $C_B$ in the vicinity of the hopper outlet 12 can be kept high enough, so that the auxiliary roller 38 can fulfill its function with reliability.

What is claimed is:

1. A device for feeding stock sheets, comprising:

hopper means for storing stock sheets in an upright posture, said hopper means including a hopper having a hopper outlet and a receiving member provided at the hopper outlet to receive an upper portion of the leading stock sheet at the hopper outlet, thereby positioning the leading stock sheet;

draw-out means for drawing out the leading stock sheet from the hopper outlet, said draw-out means including a suction pad for attracting the leading stock sheet in a position under the receiving member;

first delivery means for delivering the stock sheets in the hopper toward the hopper outlet at a first delivery position defined in the hopper;

second delivery means for delivering the stock sheets in the hopper toward the hopper outlet at a second delivery position defined between the first delivery position and the hopper outlet;

first detecting means for detecting a degree of storage of the stock sheets between the first and second delivery positions;

second detecting means for detecting a degree of storage of the stock sheets between the second delivery position and the hopper outlet; and control means for controlling operations of said first and second delivery means independently in accordance with the degrees of storage of the stock sheets detected by said first and second detecting means.

2. The device according to claim 1, wherein said control means actuates the first and second delivery means for predetermined periods of time set individually for the first and second delivery means when the degree of storage of the stock sheets are lower than predetermined values therefor, individually.

3. The device according to claim 1, wherein said first delivery means includes a first delivery roller rotatable arranged at the first delivery position, the first delivery roller having an outer peripheral surface slightly projecting from a bottom of the hopper.

4. The device according to claim 3, wherein the first delivery roller has grooves formed on an outer peripheral surface thereof, the grooves extending in an axial direction of the first delivery roller and having a width greater than a thickness of each stock sheet.

5. The device according to claim 4, wherein said first delivery means further includes an upper guide located over the first delivery roller, the upper guide having an upstream portion extending to the first delivery roller from the upstream side of the first delivery roller and a downstream portion extending close to the hopper outlet from the upstream portion, a distance between the first delivery roller and a boundary between the upstream and downstream portions being a little shorter than a height of each stock sheet.

6. The device according to claim 5, wherein the downstream portion of the upper guide has a downward groove adjacent to the boundary.

7. The device according to claim 1, wherein said second delivery means includes a second delivery roller rotatable arranged at the second delivery position, the second delivery roller having an outer peripheral surface slightly projecting from the bottom of the hopper.

8. The device according to claim 1, wherein said first detecting means includes a plurality of sensors for detecting the side edges of the stock sheets.

9. The device according to claim 1, wherein said second detecting means includes a sensor for detecting a gap between the hopper outlet and the leading stock sheet.

10. The device according to claim 1, wherein said hopper means further includes a stopper member located near the receiving member to engage with an upper end edge of the leading stock sheet.

11. The device according to claim 1, wherein said hopper means further includes resisting means for applying a draw-out resistance to the stock sheets at the hopper outlet.

12. The device according to claim 11, wherein said resisting means includes side claws located individually on opposite sides of the hopper outlet and in contact with opposite side edges of the stock sheets.

13. The device according to claim 12, wherein said resisting means further includes a lower claw in the form of an ascending stair located on a bottom edge of the hopper outlet and in contact with lower end edges of the stock sheets.

14. The device according to claim 1, wherein said draw-out means includes a central suction pad for attracting a central portion of the leading stock sheet and side suction pads for attracting opposite end portions of the leading stock sheet, the side suction pads drawing out the opposite end portions of the leading stock sheet from the hopper outlet in advance of the central suction pad.

15. The device according to claim 14, wherein said draw-out means further includes air blow means for blowing air against the stock sheets in the vicinity of the hopper outlet from either side.

* * * * *